US005937927A

United States Patent [19]

Keith

[11] Patent Number: 5,937,927

[45] Date of Patent: Aug. 17, 1999

[54] VERTICAL BLIND ENHANCEMENT APPARATUS AND METHOD OF INSTALLATION

[75] Inventor: Margaret S. Keith, Wilmington, Del.

[73] Assignee: VBF Holdings, Inc., Wilmington, Del.

[21] Appl. No.: 09/008,953

[22] Filed: Jan. 20, 1998

Related U.S. Application Data

[63] Continuation-in-part of application No. 08/391,433, Feb. 21, 1995, Pat. No. 5,715,883.

[51] Int. Cl.[6] ..... E06B 9/36

[52] U.S. Cl. ..... 160/89; 160/168.1 V; 160/178.1 V; 160/900

[58] Field of Search ..... 160/84.01, 84.03, 160/89, 84.04, 330, 168.1 V, 168.1 R, 173 R, 173 V, 176.1 R, 76.1 V, 177 R, 177 V, 178.1 R, 178.1 V, 900, 348

[56] References Cited

U.S. PATENT DOCUMENTS

| | | | |
|---|---|---|---|
| 3,844,330 | 10/1974 | Hyman . | |
| 3,851,699 | 12/1974 | Shapiro . | |
| 4,269,880 | 5/1981 | Nalepka | 160/348 |
| 4,466,476 | 8/1984 | Fairbanks . | |
| 5,012,552 | 5/1991 | Wulf . | |
| 5,101,876 | 4/1992 | Zak . | |
| 5,297,607 | 3/1994 | Beauchamp . | |
| 5,439,042 | 8/1995 | Obanesian . | |
| 5,713,407 | 2/1998 | Judkins | 160/89 |
| 5,715,883 | 2/1998 | Keith . | |
| 5,749,404 | 5/1998 | Colson | 160/84.04 |

*Primary Examiner*—Blair M. Johnson
*Attorney, Agent, or Firm*—Connolly & Hutz

[57] ABSTRACT

The present invention relates to a drapery fabric for enhancing vertical blinds. The drapery fabric is pre-formed with reception pockets for installation over the upper ends of vertical blinds. The pockets may have gaps for easy installation over preexisting vertical blinds. In one method of installation, the vertical blinds are removed from their traverse rod track, instead into the pockets with the swivel mounts passing through the gaps, and then installed upon the track. This results in the effect of "full" draperies, with the ability to optionally partially install over the length of the vertical blinds, either vertically or horizontally, and seal the gaps at the edges of standard vertical blinds.

10 Claims, 4 Drawing Sheets

VERTICAL BLIND ENHANCEMENT APPARATUS AND METHOD OF INSTALLATION

CROSS-REFERENCE TO RELATED APPLICATION

This application is a continuation-in-part of application Ser. No. 08/391,433, filed Feb. 21, 1995, now U.S. Pat. No. 5,715,883.

BACKGROUND OF THE INVENTION

1. Field of the Invention

The present invention relates to a novel fabric cover for vertical blinds, a method of installing the novel vertical blind cover, and a method of varying the vertical blind covers to achieve a varying covering on vertical blinds.

2. Description of the Prior Art

With the ever-increasing use of glass in houses, office buildings, and other forms of construction, many problems and unexpected considerations have emerged.

A living space which is glass-enclosed, without any coverings for the window (such coverings are usually termed "window treatments") has several major drawbacks.

First, the most disturbing drawback is the admission of excessive amounts of light on days in which the sun is out.

Second, at night, when interior lights are one, privacy is at a minimum. Interior living spaces, when lit, are easily viewed from the outside. This poses a problem in both a lack of security and in a lack of privacy.

Further, as the quest for energy efficiency increases, ways for reducing radiant heat loss from houses are highly sought after. First and foremost among those features which lose heat in a house are the windows.

Additionally, aesthetic considerations often pose a problem. Large blank window spaces or plain empty walls can pose a challenge for the interior designer who desires to create a living space which is pleasing to the eye.

Heretofore, many types of window treatments have been known. Draperies were (and are) popular for covering window space, as they have several advantages. When mounted on a traverse rod, they are movable, provide (depending upon the fabric weight) blockage of excessive light, and prevent excessive heat loss. Further, they can be closed for privacy and opened to admit light.

However, draperies require an extraordinarily large amount of material and can be exceptionally expensive. Furthermore, for appropriate decorative effects, such as pleating or swaging, additional large amounts of material are required. This can be overwhelmingly expensive, and lead to the instance where a consumer simply forgoes the installation of draperies.

Less expensive alternatives have been developed. Horizontal blinds (such as those marketed under the name Levelor™) are one such alternative. With the current use of low-cost injection molding techniques and the availability of high density plastics, the cost of these horizontal blinds has diminished considerably while their durability has improved.

However, horizontal blinds have several drawbacks. First, they admit substantial amounts of light even when fully closed. Second, given the very nature of the blind structure, they admit cold and let out heat in a free manner (vice-versa in the summertime). Additionally, horizontal blinds historically have been the "cheap" solution to covering blank window space. They tend to be less than aesthetically pleasing, and are available in only a very minimal selection of patterns, colors, or styles.

More recently, vertical blinds have become popular. These blinds, like horizontal blinds, are substantially less expensive than draperies. Furthermore, when mounted on a traverse rod, they provide easy opening and closing mechanisms, and are aesthetically appealing.

However, vertical blinds, like horizontal blinds, have drawbacks as well. They also tend to admit large amounts of light from between the vertical slats, sides, and top. Heat and cold flow through at will. Furthermore, vertical blinds have a unique problem in that the slightest gust of wind can cause them to sway, often for long periods of time depending upon their length. Thus, they can generate excessive noise, create disturbing light effects, and have very poor thermal efficiency.

Additionally, a significant gap is present between the surface to be covered and the blinds themselves. This gap is necessary, as the blinds must have a minimum horizontal clearance from the surface being covered, so that they may be free to rotate about their support.

The prior art has recognized this problem with vertical blinds, and solved it in the past by supplying a mounting bracket which mounts to the end of the traverse rod. A vertical blind slat is then mounted to the bracket to cover the gap at the end. However, this detracts from the aesthetics of the vertical blinds, and air flow can send this sole slat swinging at unexpectedly large distances.

Applicants are aware of "wrap draperies" for vertical blinds, i.e. a system for wrapping vertical slats with a single drapery wrap. The system requires a "clincher", which is a hook mechanism formed with Velcro™.

The hook mechanism is seated over the top of the vertical blind, and the Velcrom extends across the top of the vertical blind. The draperies are then fastened as a single sheet to the vertical blinds, utilizing the Velcro™ adhered to the top of the drapery and the corresponding Velcro™ which is hooked or otherwise attached to the top of the vertical blind.

However, this approach tends to be expensive, as it requires special "clincher" devices for engaging the fabric with the vertical blinds. This adds to installation time, materials costs, and general expense. Furthermore, to cover the sides of the window opening, additional slats and anchors are required. Finally, this method does not allow for a centrally separating vertical blind arrangement.

SUMMARY OF THE INVENTION

To overcome the problems involved in adapting vertical blinds for use in an aesthetically appealing, inexpensive, easy to install, and highly effective window treatment, this invention contemplates supplying a consumer or installer with a single drapery fabric, preformed with reception pockets for installation over the upper ends of vertical blinds.

In accordance with the present invention, a vertically oriented spatial area is covered with at least one vane of a vertical blind. Structure ls provided for supporting the vane. A vane cover has an upper end portion which includes a pocket for receiving the upper end portion of the vane. The cover includes an extension at one side thereof for removable attachment to a fixed surface such as a wall adjacent the spatial area. Structure also is provided for attaching the cover extension to the fixed surface.

In one method of installation, the vertical blinds are removed from their traverse rod track, inserted into the pockets, and then installed upon the track. This results in the effect of "full" draperies, with the ability to optionally partially install over the length of the vertical blinds, either vertically or horizontally.

Furthermore, the fabric extension used may be attached to the wall directly, using a ring hook embedded in the wall or other means, without need of an additional slat or van on the side.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figure 1:
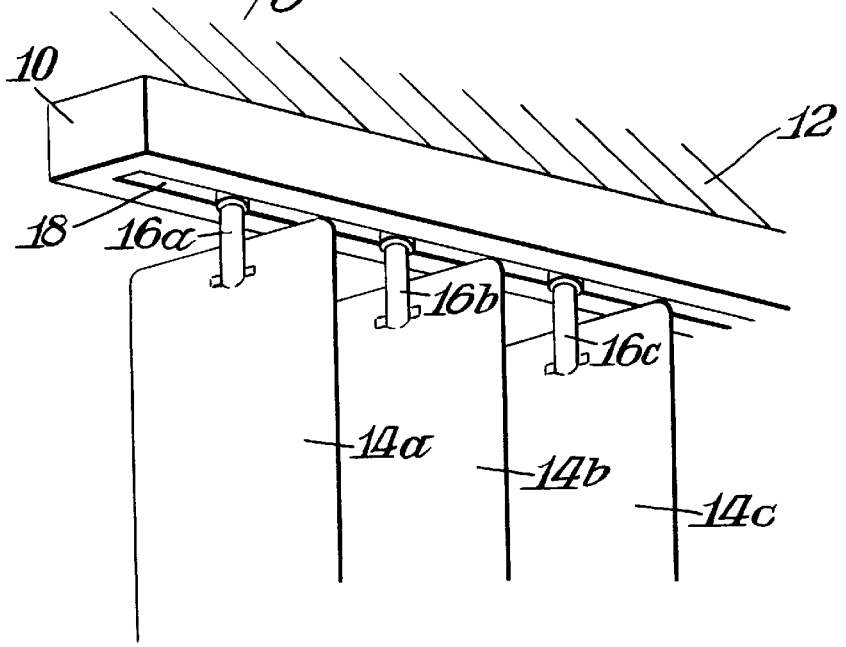
Fig. 1 (Prior Art)
FIG. 1 illustrates the prior art with respect to standard vertical blinds.

FIG. 1 is a diagrammatic representation of standard vertical blinds. Traverse rod 10 is affixed to a fixed surface such as a ceiling 12 for firm support. Vanes 14*a,* 14*b* and 14*c* are mounted upon pivoting hooks 16*a,* 16*b,* and 16*c.* Pivoting hooks 16*a,* 16*b,* and 16*c,* are slidably mounted in track 18.

By operation of a pulley system, the vanes may be slid apart from the center, or from side to side as one long unit.

Figure 2:
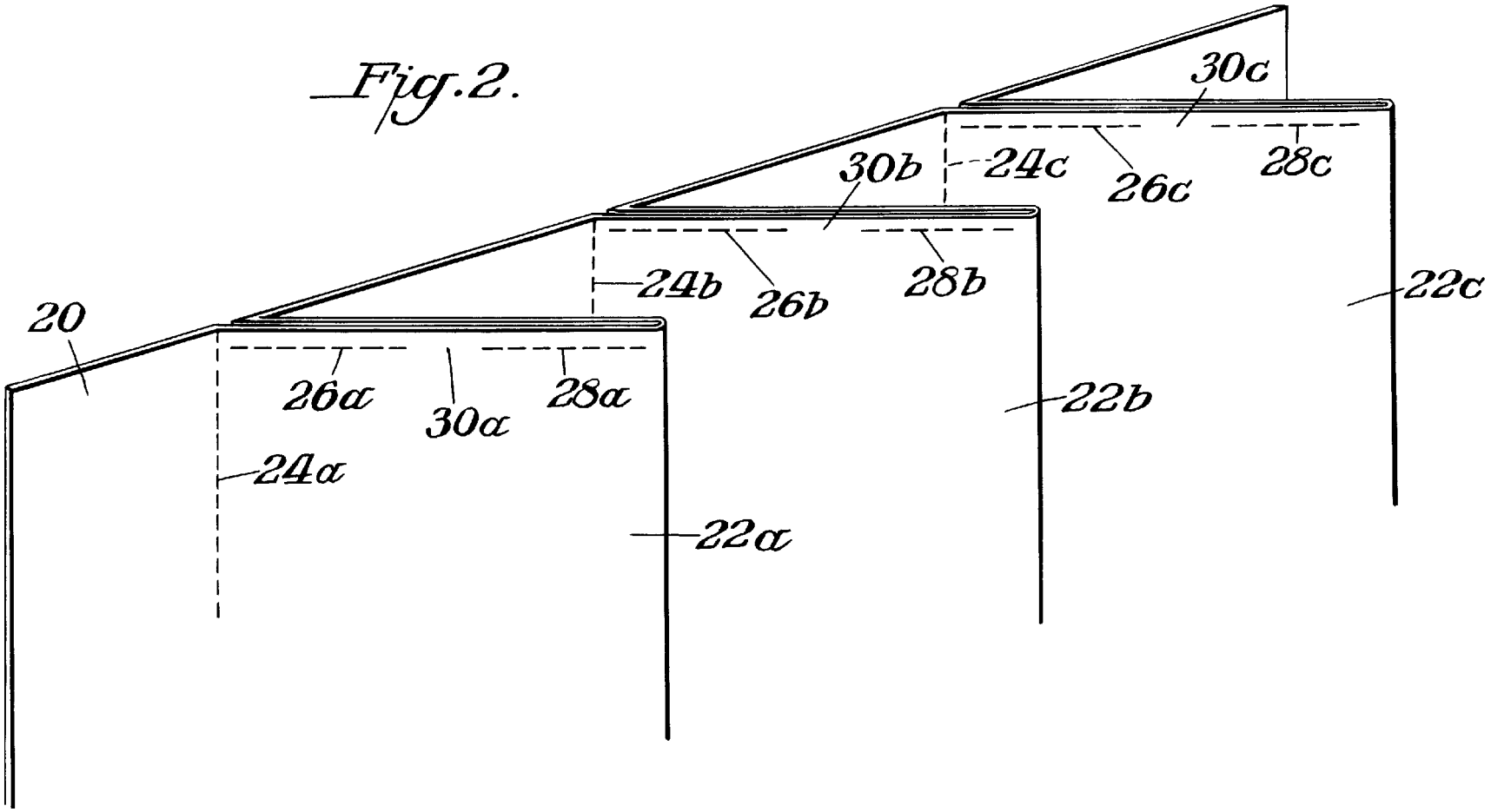
FIG. 2 is a diagrammatic view of a vertical blind enhancement apparatus, according to the present invention.

FIG. 2 is a diagrammatic illustration of the invention. Fabric material 20, which may be a woven, nonwoven, spun-bonded, natural, synthetic, or other fabric make or blend, is stitched into receiving pocket areas 22*a,* 22*b,* 22*c.*

The stitching is generally done with three stitch rows. A first vertical row of stitches 24*a,* 24*b,* and 24*c* is made in the fabric material to form the basic pocket. The second and third rows of stitches are lined up along the upper edge of the pocket formed by the first stitch. The stitching passes may be done simultaneously by action of an industrial sewing machine. Stitches 26*a,* and 28*a,* 28*b* may be made in a single pass.

The stitch may be interrupted at gap(s) 30*a,* 30*b,* and 30*c* to allow for the insertion of the swivel member of the vertical blinds. The width of the pocket is tailored to the width of the vertical blind, and a certain amount of fabric (usually 2–12 inches, preferably 5–9 inches) is left to loosely connect the two pockets, to give a pleasing drapery effect, and to allow for swiveling of the vertical blind vanes. An additional 2–12 inches may optionally be left at the very ends of the fabric covering the vertical blinds for attachment to the wall.

Figure 3:
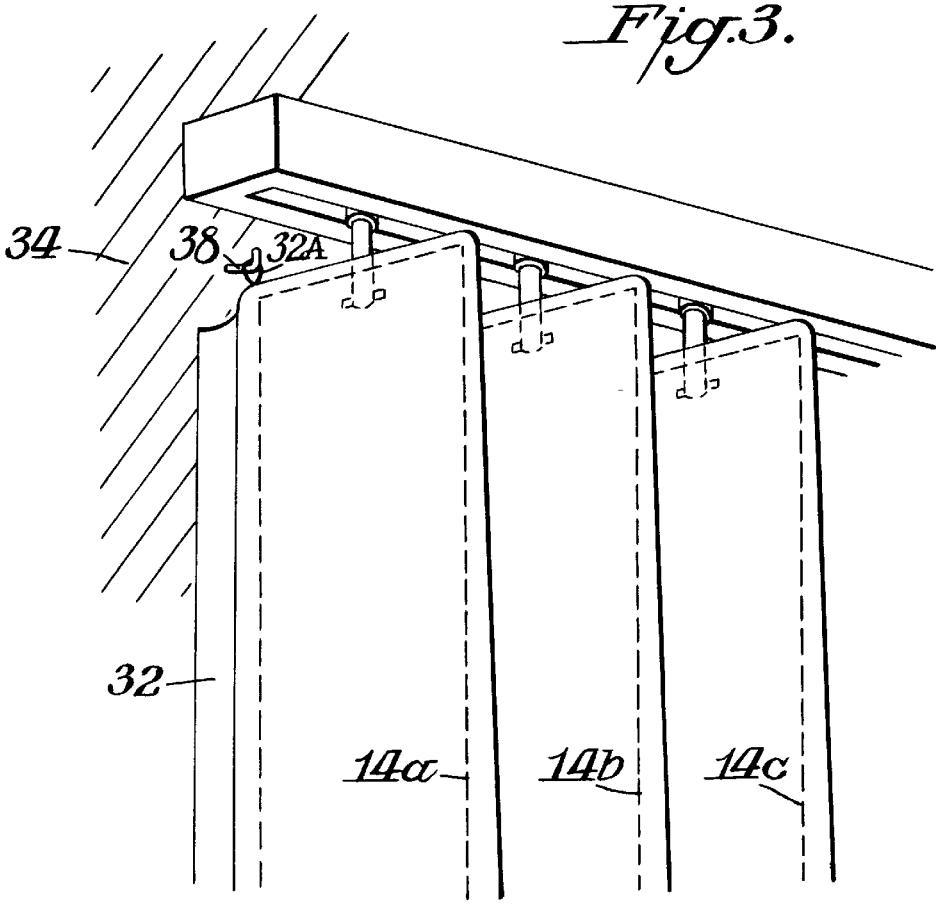
FIG. 3 is a diagrammatic view of the present invention installed upon a set of vertical blinds.

FIG. 3 is a diagrammatic representation of the invention as installed upon a set of vertical blinds. The vertical blind vane 14 is shown in phantom while encased by the fabric of the invention. Fabric leaf 32 is optionally provided for removable attachment to a fixed surface such as wall 34. Hooks and rings are commonly utilized in the drapery art to secure fabric to an adjacent wall structure. In this regard, fabric leaf or extension 32 may be attached to the wall 34 by means of a hook and ring fastener.

Figure 4:
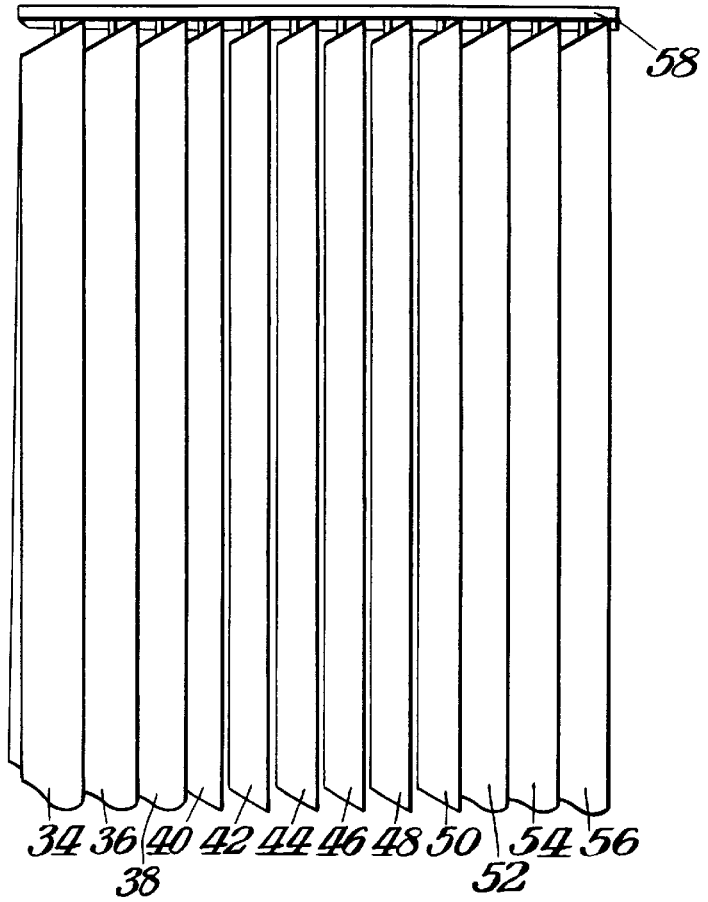
FIG. 4 is a diagrammatic view of a preferred embodiment of the present invention.

FIG. 4 is a diagrammatic representation of a preferred embodiment of the present invention. Vanes 34, 36, and 38 are covered by the fabric of the present invention, while vanes 40–50 are not covered. Vanes 52–56 are in turn covered by the fabric of the present invention.

Traverse rod 58 may be set up internally to enable the vertical blinds to be spread from the center upon pulling of the draw cord, or the whole unit may move in one complete motion from side to side (single or "one" draw).

Figure 5:
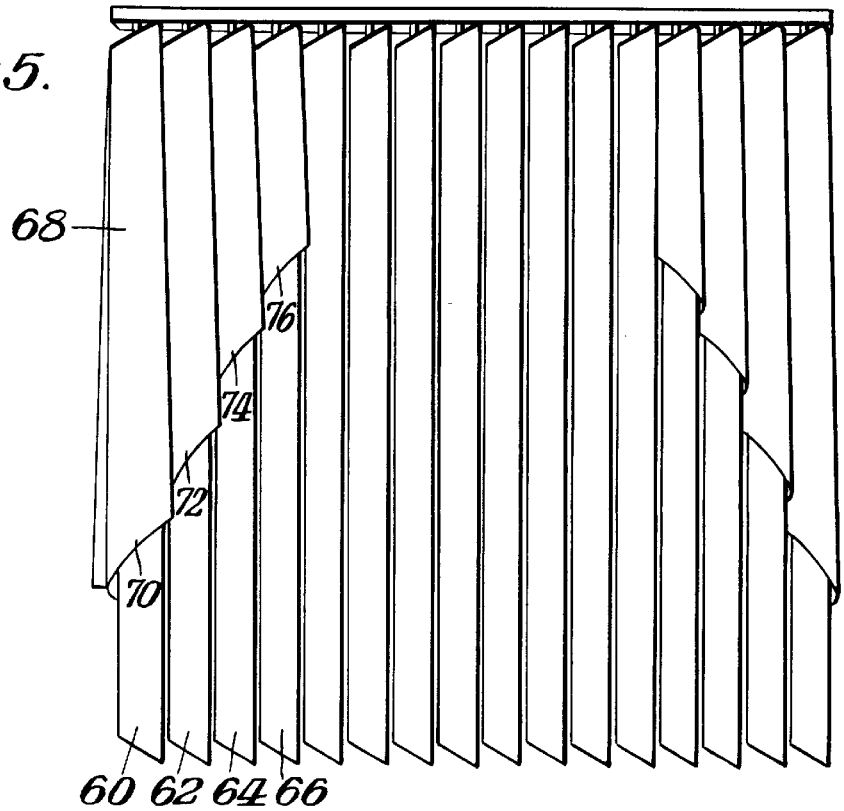
FIG. 5 is a diagrammatic view of an alternate embodiment of the present invention.

FIG. 5 is a graphical representation of an alternative installation of the present invention. Vanes 60–66 are partially covered by the fabric of the instant invention. Fabric 68 is formed with bottom edge. 70, 72, 74 and 76 which ascend in a preselected manner. This varying-length coverage is achieved by forming the vertical blind vane cover in a varying vertical length.

Figure 6:
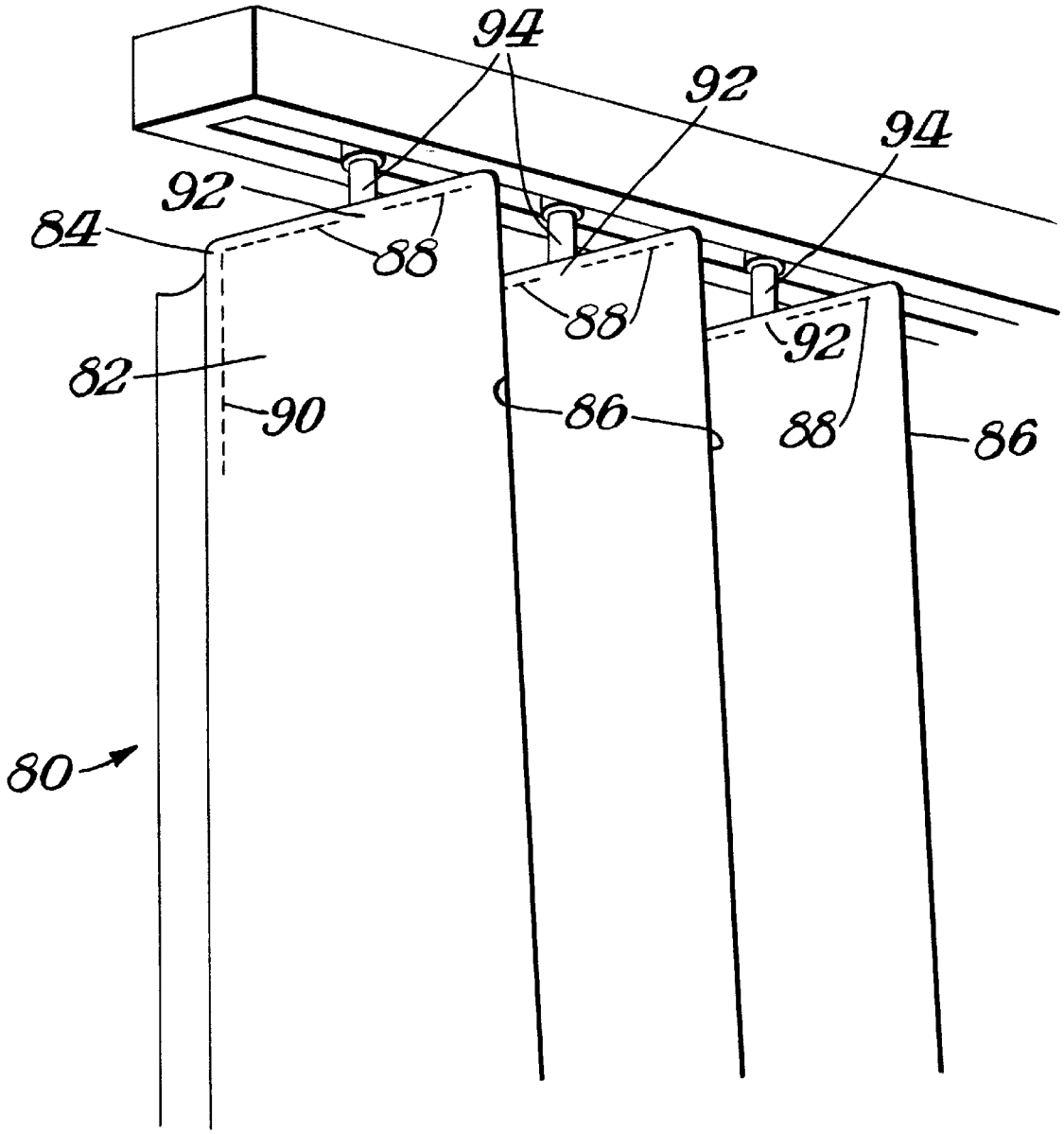
FIG. 6 is a diagrammatic view of a vertical blind enhancement apparatus, according to the present invention.

FIG. 6 illustrates a cover 80 for the vanes of a vertical blind arrangement. The cover is very similar to the cover illustrated in FIGS. 2 and 3 except for the formation of the vane receiving pockets 82. Specifically, FIG. 6 shows vane receiving pockets only at the upper portion 84 of the cover. Each pocket is formed by fabric folded along outside edge 86, and appropriate horizontal stitching 88 along the top with a short length of vertical stitching 90 along the side opposite the fold 86. The stitching 88 is interrupted at gap 92 to allow insertion of the swivel member 94 of the vertical blinds. Each pocket 82 is closed along fold 86, and stitching 88, 90. Otherwise, the overall system is the same as described above.

Again, the present invention may be set on a traverse rod with the ability to separate in the middle, or move in a single ("one") draw motion.

Various embodiments of the present invention will readily become apparent to one of skill in the art, having regard for the instant disclosure.

The present invention allows, surprisingly, for increased usage of fabric and blind materials in decorating residences, offices, and other living spaces in novel ways heretofore undisclosed in the art.

Having described the instant invention as in the foregoing, I claim:

1. An apparatus for covering a vertically oriented spatial area having opposed sides comprising:

a plurality of vertical blind vanes extending across the spatial area from one side thereof to the other, each vane having a vane upper end portion, means for supporting the vanes, and a vane cover comprising a sheet and having a vane cover upper end portion, each vane having a top edge, a bottom edge and opposed longitudinal side edges, a plurality of pockets formed in at least the vane cover upper end portion for receiving upper end portions of at least some of the vanes, the upper end portions of the vanes each comprising the top edge and at least an upper portion of at least one of the longitudinal side edges, each pocket being spaced from an adjacent pocket and interconnected thereto by portions of the vane cover, each pocket having an upper edge adjacent the vane top edge and at least one closed side edge extending therefrom, the upper edge of each pocket defined by at least a portion of the sheet directly attached to an adjacent portion thereof, and at least some of the vanes on each side of the plurality received within the pockets of the vane cover.

2. The apparatus as claimed in claim 1, wherein the means for supporting the vanes comprises a traverse rod having a plurality of slidably mounted rotatable supports, one connected to each vane.

3. An apparatus as claimed in claim 1, wherein the vane cover is formed of a fabric material.

4. An apparatus as claimed in claim 1, wherein the vane cover is a plastic fabric.

5. An apparatus as claimed in claim 3, wherein the vane cover is a woven fabric.

6. An apparatus as claimed in claim 3, wherein the vane cover is a non-woven fabric.

7. An apparatus as claimed in claim 1, wherein some of the vanes on each side of the plurality are received within the pockets in the vane cover while the vanes in-between are not received within any pockets.

8. An apparatus as claimed in claim 1, wherein the vane cover includes a vertical extension on at least one side thereof for removable attachment to a fixed surface adjacent one side of the spatial area.

9. A vertical blind cover apparatus, comprising a flexible base fabric having an upper end, a plurality of pockets at the upper end of the flexible base fabric, each pocket being spaced from an adjacent pocket and interconnected by portions of the flexible base fabric, each pocket being formed with a substantially closed upper edge and at least one opposing closed side edge extending therefrom, the upper edge of each pocket defined by at least a portion of the fabric directly attached to an adjacent portion thereof, and a plurality of vanes of a vertical blind with at least some of the plurality of vanes positioned within the pockets of the cover.

10. An apparatus as claimed in claim 9, wherein the vertical blind cover covers less than all of the vertical blind vanes.

* * * * *